US011551846B2

(12) United States Patent
Hamachi et al.

(10) Patent No.: US 11,551,846 B2
(45) Date of Patent: Jan. 10, 2023

(54) MULTILAYER COIL COMPONENT

(71) Applicant: TDK Corporation, Tokyo (JP)

(72) Inventors: Noriaki Hamachi, Tokyo (JP); Kazuya Tobita, Tokyo (JP); Youichi Kazuta, Tokyo (JP); Yuto Shiga, Tokyo (JP)

(73) Assignee: TDK CORPORATION, Tokyo (JP)

( * ) Notice: Subject to any disclaimer, the term of this patent is extended or adjusted under 35 U.S.C. 154(b) by 338 days.

(21) Appl. No.: 16/876,927

(22) Filed: May 18, 2020

(65) Prior Publication Data

US 2020/0388426 A1 Dec. 10, 2020

(30) Foreign Application Priority Data

Jun. 5, 2019 (JP) ..... JP2019-105108

(51) Int. Cl.
*H01F 17/00* (2006.01)
*H01F 3/14* (2006.01)
*H01F 27/29* (2006.01)

(52) U.S. Cl.
CPC ..... *H01F 17/0013* (2013.01); *H01F 3/14* (2013.01); *H01F 27/292* (2013.01); *H01F 2017/002* (2013.01)

(58) Field of Classification Search
CPC ..... H01F 17/0013; H01F 3/14; H01F 27/292; H01F 2017/002
See application file for complete search history.

(56) References Cited

U.S. PATENT DOCUMENTS

2010/0109829 A1 5/2010 Sugiyama et al.
2016/0141102 A1* 5/2016 Tseng ..... H01F 27/292 336/200
2017/0004918 A1* 1/2017 Kido ..... H01F 5/00

FOREIGN PATENT DOCUMENTS

JP 2010-109116 A 5/2010

* cited by examiner

*Primary Examiner* — Dinh T Le
(74) *Attorney, Agent, or Firm* — Oliff PLC

(57) ABSTRACT

A coil is disposed in an element body such that a gap between the coil and a first principal surface is larger than a gap between the coil and a second principal surface, and has a coil axis along a direction intersecting with a direction in which the first principal surface and the second principal surface oppose each other. A terminal electrode is disposed on the element body such that at least a part of the first principal surface and a part of the second principal surface are exposed. The coil includes a plurality of coil conductors separated from each other in a direction along the coil axis and a through-hole conductor connecting the coil conductors adjacent to each other in the direction along the coil axis. The through-hole conductor does not overlap the plurality of terminal electrodes when viewed from the direction along the coil axis.

3 Claims, 7 Drawing Sheets

MULTILAYER COIL COMPONENT

BACKGROUND OF THE INVENTION

1. Field of the Invention

The present invention relates to a multilayer coil component.

2. Description of Related Art

Known multilayer coil components include an element body, a coil disposed in the element body, a plurality of terminal electrodes disposed on the element body, and a plurality of connection conductors connecting an end of the coil and the terminal electrode that correspond to each other (see, for example, Japanese Unexamined Patent Publication No. 2010-109116).

SUMMARY OF THE INVENTION

The element body includes a first principal surface arranged to constitute a mounting surface and a second principal surface opposing the first principal surface. The coil includes a plurality of coil conductors separated from each other. In a multilayer coil component manufacturing process (firing process), a metal component for forming the coil conductor may function as an accelerator at a time when the element body is sintered. In a case where the metal component functions as the accelerator, sinterability of a region of the element body that is positioned near the coil (coil conductor) may be enhanced. In this case, the region may be excessively fired.

In a case where the multilayer coil component is solder-mounted on an electronic device, an external force acting on the multilayer coil component from the electronic device may act as stress on the element body. The external force acts on the element body through the terminal electrode from solder fillet formed during solder mounting. The external force tends to, for example, act on the first principal surface. Cracks may occur in the excessively fired region in a case where the external force acting on the first principal surface acts on the excessively fired region. The coil (coil conductor) may be disconnected in a case where the cracks progress to the coil. The electronic device includes, for example, a circuit board or an electronic component.

In a configuration in which the excessively fired region is away from the first principal surface, that is, in a configuration in which the coil (coil conductor) is away from the first principal surface, the external force tends not to act on the excessively fired region even in a case where the external force acts on the first principal surface.

In a configuration in which the coil has a coil axis along the direction in which the first principal surface and the second principal surface oppose each other, each coil conductor is disposed in, for example, a plane orthogonal to the direction in which the first principal surface and the second principal surface oppose each other. In this case, a gap tends to be left between the first principal surface and the coil (coil conductor closest to the first principal surface among the plurality of coil conductors).

In contrast, in a configuration in which the coil has a coil axis along, for example, a direction orthogonal to the direction in which the first principal surface and the second principal surface oppose each other, each coil conductor is disposed in a plane along the direction in which the first principal surface and the second principal surface oppose each other. In this case, a gap tends not to be left between the first principal surface and the coil. When the gap between the first principal surface and the coil is increased, an inner diameter of the coil tends to decrease and characteristics of the multilayer coil component may deteriorate.

An object of one aspect of the present invention is to provide a multilayer coil component that controls occurrence of cracks in an element body and reduces deterioration in characteristics even in a case where a coil has a coil axis along a direction orthogonal to the direction in which a first principal surface and a second principal surface oppose each other.

A multilayer coil component according to one aspect includes an element body, a coil, a plurality of terminal electrodes, and a plurality of connection conductors. The element body includes a first principal surface constituting a mounting surface, a second principal surface opposing the first principal surface in a first direction, a pair of side surfaces opposing each other in a second direction orthogonal to the first direction, and a pair of end surfaces opposing each other in a third direction orthogonal to the first direction and the second direction. The coil has a coil axis along the second direction and is disposed in the element body such that a gap between the coil and the first principal surface is larger than a gap between the coil and the second principal surface. The plurality of terminal electrodes is disposed on the first principal surface, the second principal surface, the pair of side surfaces, and a corresponding end surface of the pair of end surfaces. The plurality of connection conductors connect an end of the coil and the terminal electrode corresponding to each other and extend along the first direction. The coil includes a plurality of coil conductors separated from each other in the second direction and a through-hole conductor connecting the coil conductors adjacent to each other in the second direction. The through-hole conductor does not overlap the plurality of terminal electrodes when viewed from the second direction.

In the above-described aspect, the coil is disposed in the element body such that the gap between the coil and the first principal surface is larger than the gap between the coil and the second principal surface.

In the configuration in which the gap between the coil and the first principal surface is larger than the gap between the coil and the second principal surface, the gap between the first principal surface and the coil tends to be left and the coil tends to be away from the first principal surface. Therefore, even in a case where sinterability of a region of the element body that is positioned near the coil is enhanced, an external force tends not to act on the region that is positioned near the coil. Consequently, the above-described aspect controls occurrence of cracks in the element body.

In the configuration in which the gap between the coil and the second principal surface is smaller than the gap between the coil and the first principal surface, an inner diameter of the coil tends not to decrease even in a case where the coil is away from the first principal surface. Therefore, the configuration in which the gap between the coil and the second principal surface is smaller than the gap between the coil and the first principal surface controls a decrease in inductance.

The connection conductor extends along the first direction. In other words, the connection conductor has an approximately linear shape. In this configuration, a length of the connection conductor is small and a change in shape tends not to occur in any place as compared with, for example, a configuration in which the connection conductor has an approximately L shape. A decrease in Q value may occur in a case where the connection conductor has a region where a change in shape occurs. Therefore, the configuration in which the connection conductor extends along the first direction controls an increase in direct current resistance of the connection conductor and a decrease in Q value.

When viewed from the second direction, the through-hole conductor does not overlap the plurality of terminal electrodes. The through-hole conductor is connected to an end of the coil conductor. At the end of the coil conductor, a conductor width is increased so that the end of the coil conductor and the through-hole conductor are reliably connected. In a configuration in which the through-hole conductor overlaps the terminal electrode when viewed from the second direction, the end of the coil conductor may overlap the terminal electrode when viewed from the second direction. In this case, stray capacitance that is formed between the coil and the terminal electrode may increase due to the large conductor width at the end of the coil conductor. The increase in stray capacitance results in a decrease in a self-resonant frequency of the multilayer coil component. In contrast, in the configuration in which the through-hole conductor does not overlap the plurality of terminal electrodes when viewed from the second direction, the stray capacitance that is formed between the coil and the terminal electrode tends not to increase and the self-resonant frequency of the multilayer coil component tends not to decrease even in a case where the conductor width at the end of the coil conductor is large.

Consequently, the above-described aspect reduces deterioration in the characteristics of the multilayer coil component.

The present invention will become more fully understood from the detailed description given hereinafter and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating embodiments of the invention, are given by way of illustration only, since various changes and modifications within the spirit and scope of the invention will become apparent to those skilled in the art from this detailed description.

DETAILED DESCRIPTION OF EMBODIMENTS

Figure 1:
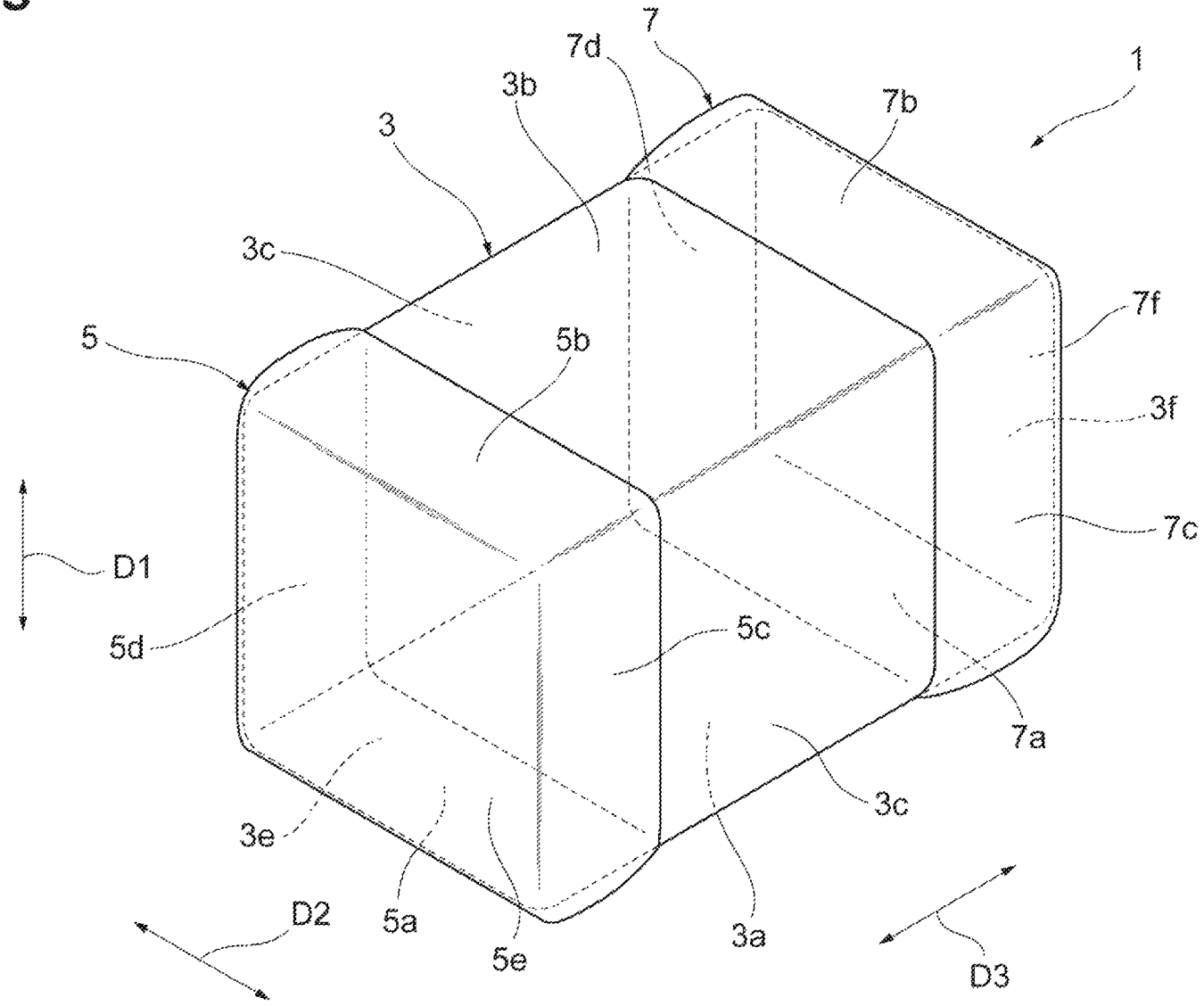
FIG. 1 is a perspective view illustrating a multilayer coil component according to an embodiment.

Hereinafter, embodiments of the present invention will be described in detail with reference to the accompanying drawings. In the following description, the same elements or elements having the same functions are denoted with the same reference numerals and overlapped explanation is omitted.

Figure 2:
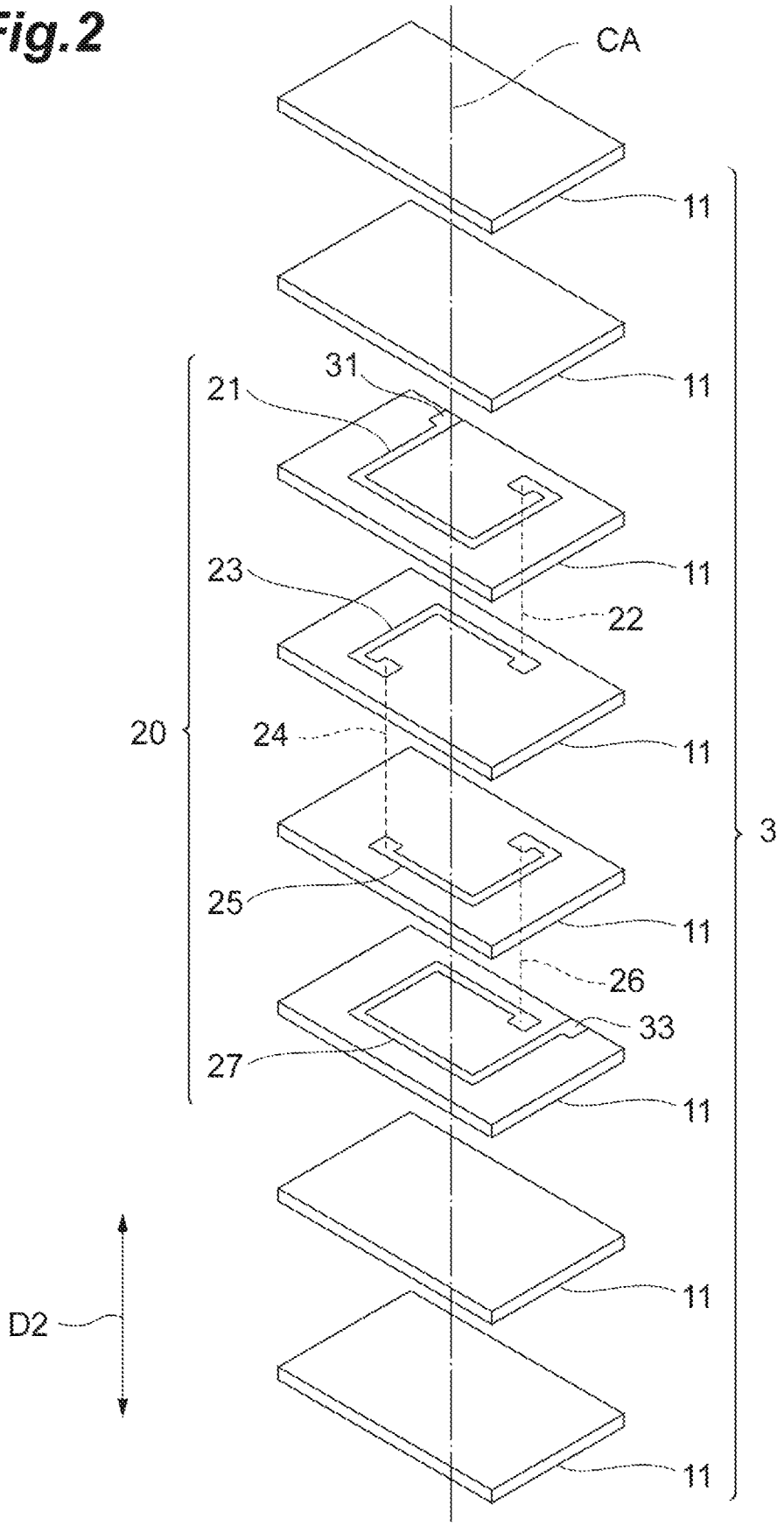
FIG. 2 is a perspective view illustrating a configuration of an element body and a coil.
Figure 3:
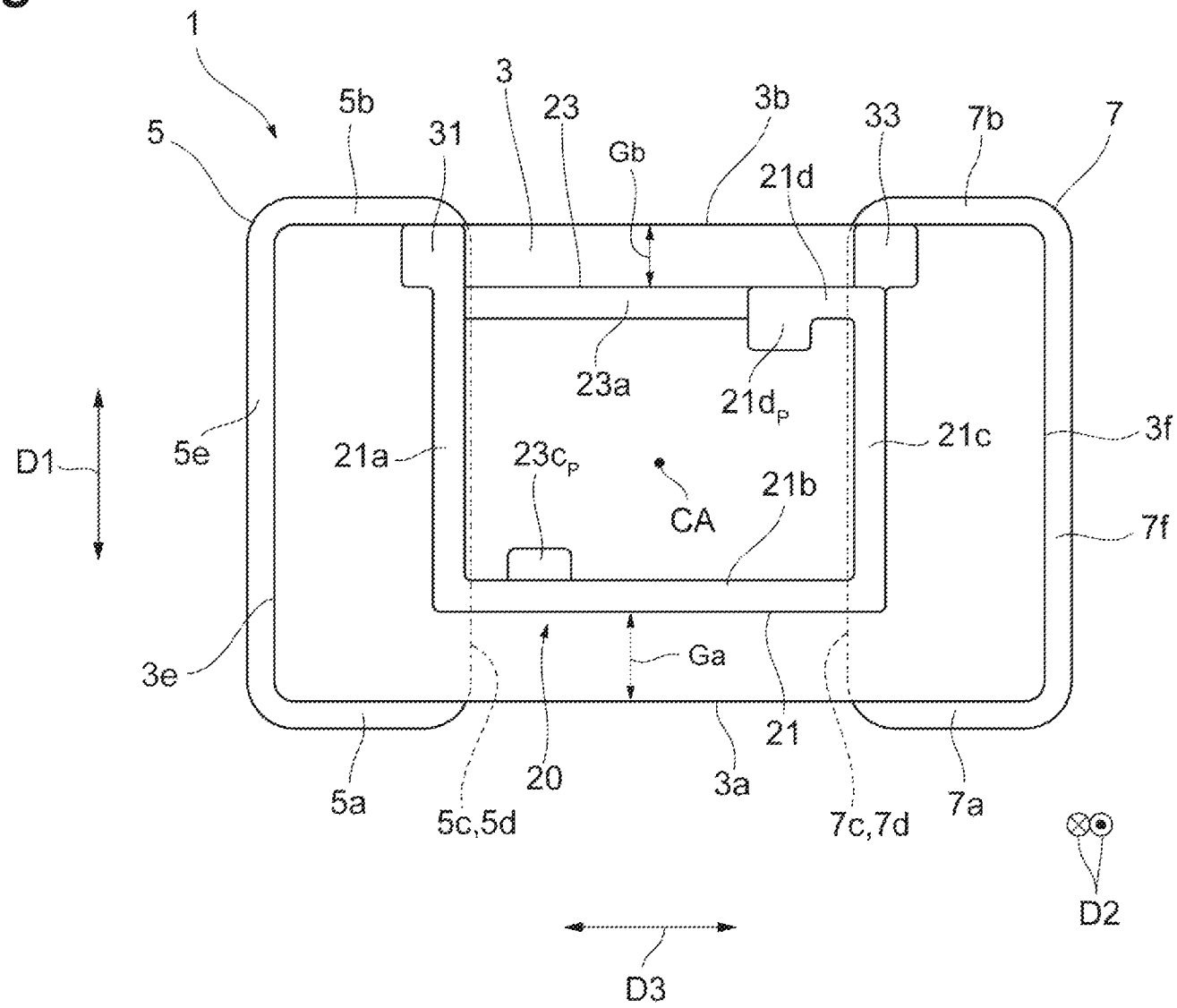
FIG. 3 is a diagram illustrating a configuration of the element body, a terminal electrode, and the coil.

A configuration of a multilayer coil component 1 according to the present embodiment will be described with reference to FIGS. 1 to 7. FIG. 1 is a perspective view illustrating the multilayer coil component according to the present embodiment. FIG. 2 is a perspective view illustrating a configuration of an element body and a coil. FIG. 3 is a diagram illustrating a configuration of the element body, a terminal electrode, and the coil. FIGS. 4 to 7 are diagrams illustrating a configuration of a coil conductor and a through-hole conductor.

As illustrated in FIG. 1, the multilayer coil component 1 includes an element body 3 and a plurality of terminal electrodes 5 and 7. In the present embodiment, the multilayer coil component 1 includes a pair of terminal electrodes 5 and 7.

The element body 3 has a rectangular parallelepiped shape. The element body 3 includes a pair of principal surfaces 3*a* and 3*b* opposing each other, a pair of side surfaces 3*c* opposing each other, and a pair of end surfaces 3*e* and 3*f* opposing each other. In the present specification, the rectangular parallelepiped shape includes a rectangular parallelepiped shape in which a corner and a ridge line are chamfered and a rectangular parallelepiped shape in which a corner and a ridge line are rounded. For example, the principal surface 3*b* constitutes a second principal surface in a case where the principal surface 3*a* constitutes a first principal surface.

The pair of principal surfaces 3*a* and 3*b*, the pair of side surfaces 3*c*, and the pair of end surfaces 3*e* and 3*f* have a rectangular shape. A direction in which the pair of principal surfaces 3*a* and 3*b* opposes each other is a first direction D1. A direction in which the pair of side surfaces 3*c* opposes each other is a second direction D2. A direction in which the pair of end surfaces 3*e* and 3*f* opposes each other is a third direction D3. The multilayer coil component 1 is solder-mounted onto an electronic device. The electronic device includes, for example, a circuit board or an electronic component. In the multilayer coil component 1, the principal surface 3*a* opposes the electronic device. The principal surface 3*a* is arranged to constitute a mounting surface. The principal surface 3*a* is a mounting surface. In the present specification, the rectangular shape includes, for example, a shape in which each corner is chamfered and a shape in which each corner is rounded.

The pair of side surfaces 3*c* extends in the first direction D1 to couple the pair of principal surfaces 3*a* and 3*b*. The pair of side surfaces 3*c* also extends in the third direction D3. The pair of end surfaces 3*e* and 3*f* extends in the first direction D1 to couple the pair of principal surfaces 3*a* and 3*b*. The pair of end surfaces 3*e* and 3*f* also extends in the second direction D2. The first direction D1 is a direction orthogonal to each of the principal surfaces 3*a* and 3*b* and is orthogonal to the second direction D2. The third direction D3 is a direction parallel to each of the principal surfaces 3*a* and 3*b* and each of the side surfaces 3*c* and is orthogonal to the first direction D1 and the second direction D2. The second direction D2 is a direction orthogonal to each of the side surfaces 3*c*, and the third direction D3 is a direction orthogonal to each of the end surfaces 3*e* and 3*f*.

As illustrated in FIG. 2, the element body 3 is configured by laminating a plurality of insulator layers 11. The element body 3 includes the plurality of laminated insulator layers 11. Each insulator layer 11 is laminated in the second direction D2. Each insulator layer 11 has a rectangular shape when viewed from the second direction D2. In the actual element body 3, the insulator layers 11 are integrated to an extent that boundaries between the insulator layers 11 cannot be visually recognized. Each insulator layer 11 includes, for example, a sintered body of a ceramic green sheet containing a non-magnetic material.

The non-magnetic material is, for example, a dielectric material containing a glass component. The dielectric material is, for example, $BaTiO_3$-based, $Ba(Ti, Zr)O_3$-based, or $(Ba, Ca)TiO_3$-based dielectric ceramic. The glass component is, for example, borosilicate glass. The non-magnetic material may be a glass ceramic material or a dielectric material. Each insulator layer 11 may include a sintered body of a ceramic green sheet containing a magnetic material. The magnetic material is, for example, a Ni-Cu-Zn-based ferrite material, a Ni—Cu—Zn—Mg-based ferrite material, or a Ni—Cu-based ferrite material.

As illustrated in FIG. 1, the terminal electrodes 5 and 7 are respectively disposed in both end portions of the element body 3 in the third direction D3. The terminal electrode 5 is disposed on the end surface 3*e* side of the element body 3, and the terminal electrode 7 is disposed on the end surface 3*f* side of the element body 3. The terminal electrode 5 and the terminal electrode 7 are separated in the third direction D3. Each of the terminal electrodes 5 and 7 contains a conductive material (for example, Ag or Pd). Each of the terminal electrodes 5 and 7 is configured as a sintered body of conductive paste containing conductive metal powder (for example, Ag powder or Pd powder) and glass frit. A plating layer may be formed on the surface of each of the terminal electrodes 5 and 7. The plating layer is formed by, for example, electroplating. For example, Ni plating or Sn plating is used for the electroplating.

The terminal electrode 5 includes five electrode portions 5*a*, 5*b*, 5*c*, 5*d*, and 5*e*. The electrode portion $5_a$ is positioned on the principal surface 3*a*. The electrode portion $5_b$ is positioned on the principal surface 3*b*. The electrode portion $5_c$ is positioned on one side surface 3*c*. The electrode portion $5_d$ is positioned on the other side surface 3*c*. The electrode portion $5_e$ is positioned on the end surface 3*e*. The terminal electrode 5 is disposed on the pair of principal surfaces 3*a* and 3*b*, the pair of side surfaces 3*c*, and the end surface 3*e*. The electrode portion $5_e$ covers the entire end surface 3*e*. The electrode portion 5*a* covers a part of the principal surface 3*a*. The electrode portion 5*b* covers a part of the principal surface 3*b*. The electrode portion 5*c* covers a part of the side surface 3*c*. The five electrode portions 5*a*, 5*b*, 5*c*, 5*d*, and $5_e$ are integrally formed.

The terminal electrode 7 includes five electrode portions 7*a*, 7*b*, 7*c*, 7*d*, and 7*f*. The electrode portion 7*a* is positioned on the principal surface 3*a*. The electrode portion 7*b* is positioned on the principal surface 3*b*. The electrode portion 7*c* is positioned on one side surface 3*c*. The electrode portion 7*d* is positioned on the other side surface 3*c*. The electrode portion 7*f* is positioned on the end surface 3*f*. The terminal electrode 5 is disposed on the pair of principal surfaces 3*a* and 3*b*, the pair of side surfaces 3*c*, and the end surface 3*f*. The electrode portion 7*f* covers the entire end surface 3*f*. The electrode portion 7*a* covers a part of the principal surface 3*a*. The electrode portion 7*b* covers a part of the principal surface 3*b*. The electrode portion 7*c* covers a part of one side surface 3*c*. The electrode portion 7*d* covers a part of the other side surface 3*c*. The five electrode portions 7*a*, 7*b*, 7*c*, 7*d*, and 7*f* are integrally formed. The terminal electrodes 5 and 7 are disposed on the element body 3 such that at least a part of the principal surface 3*a* and a part of the principal surface 3*b* are exposed.

The multilayer coil component 1 includes a coil 20 and a plurality of connection conductors 31 and 33 as illustrated in FIGS. 2 and 3. In the present embodiment, the multilayer coil component 1 includes a pair of connection conductors 31 and 33. The coil 20 is disposed in the element body 3. The coil 20 includes a plurality of coil conductors 21, 23, 25, and 27 and a plurality of through-hole conductors 22, 24, and 26. In the present embodiment, the coil 20 includes four coil conductors 21, 23, 25, and 27 and three through-hole conductors 22, 24, and 26. The coil conductors 21, 23, 25, and 27, the through-hole conductors 22, 24, and 26, and the connection conductors 31 and 33 contain a conductive material (for example, Ag or Pd). Each of the coil conductors 21, 23, 25, and 27 is configured as a sintered body of conductive paste containing a conductive material (for example, Ag powder or Pd powder).

The coil conductors 21, 23, 25, and 27 are separated from each other in the second direction D2. The coil conductor 21 and the coil conductor 23 are adjacent to each other in the second direction D2 in a state where at least one insulator layer 11 is positioned between the coil conductor 21 and the coil conductor 23. The coil conductor 23 and the coil conductor 25 are adjacent to each other in the second direction D2 in a state where at least one insulator layer 11 is positioned between the coil conductor 23 and the coil conductor 25. The coil conductor 25 and the coil conductor 27 are adjacent to each other in the second direction D2 in a state where at least one insulator layer 11 is positioned between the coil conductor 25 and the coil conductor 27. The coil conductors 21, 23, 25, and 27 are distributed in the second direction D2. Therefore, the coil 20 has a coil axis CA along the second direction D2. The second direction D2 is also a direction along the coil axis CA. The coil axis CA is along a direction intersecting with the first direction D1. In the present embodiment, the coil axis CA is approximately orthogonal to the first direction D1. The coil 20 has a polygonal shape when viewed from the second direction D2. In the present embodiment, the coil 20 has a quadrangular shape when viewed from the second direction D2.

Figure 4:
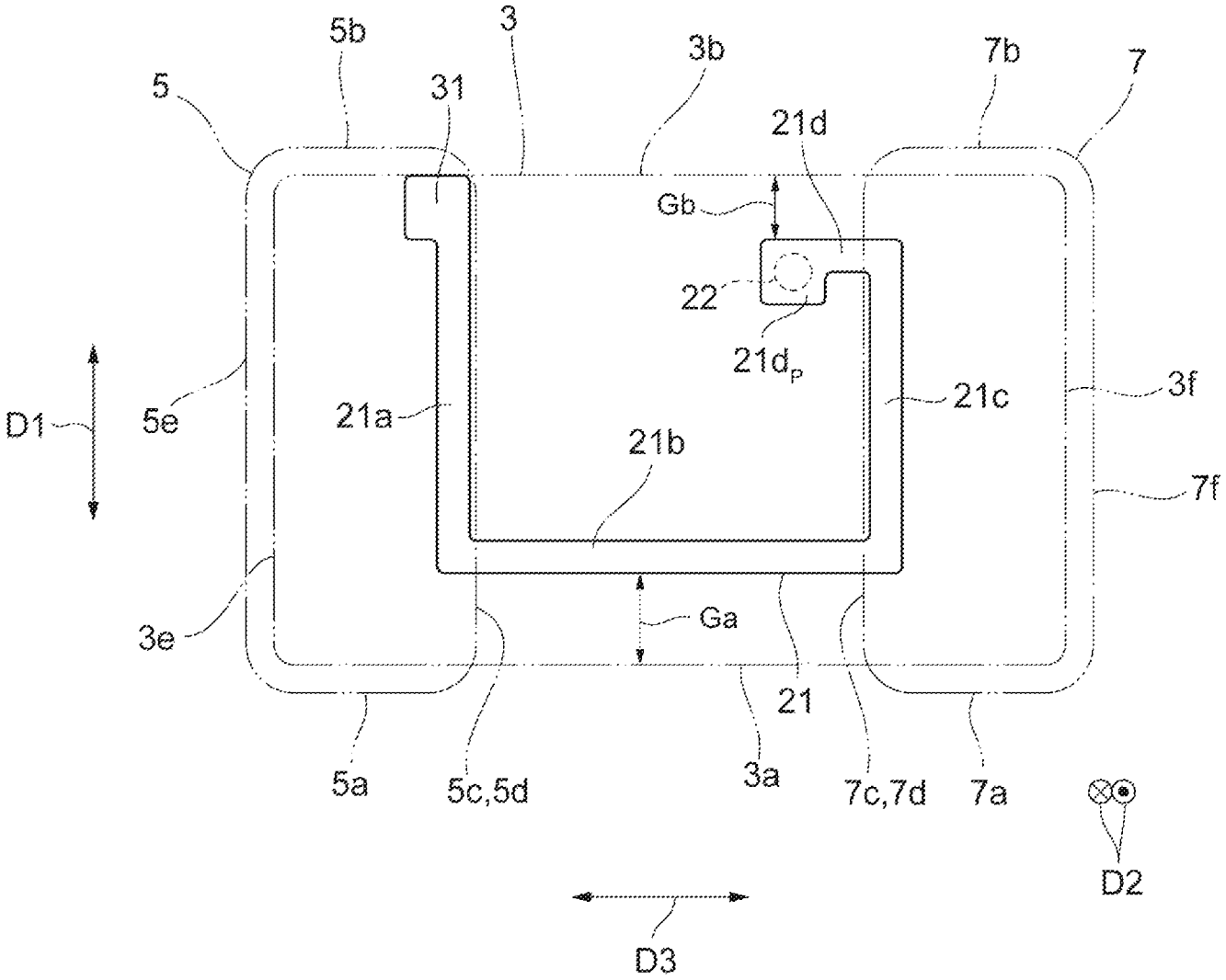
FIG. 4 is a diagram illustrating a configuration of a coil conductor and a through-hole conductor.

As illustrated in FIG. 4, the coil conductor 21 includes a plurality of conductor portions 21*a*, 21*b*, 21*c*, and 21*d*. The conductor portion 21*a* is positioned closer to the end surface 3*e*. The conductor portion 21*b* is positioned closer to the principal surface 3*a*. The conductor portion 21*c* is positioned closer to the end surface 3*f*. The conductor portion 21*d* is positioned closer to the principal surface 3*b*. The conductor portion 21*d* includes a pad region $21d_P$. The pad region $21d_P$ is positioned at an end of the conductor portion 21*d*. A conductor width of the pad region $21d_P$ is larger than a conductor width of the region other than the pad region $21d_P$. When viewed from the second direction D2, the pad region $21d_P$ does not overlap the terminal electrodes 5 and 7. The pad region $21d_P$ is positioned to be exposed from the terminal electrodes 5 and 7 when viewed from the second direction D2.

Figure 5:
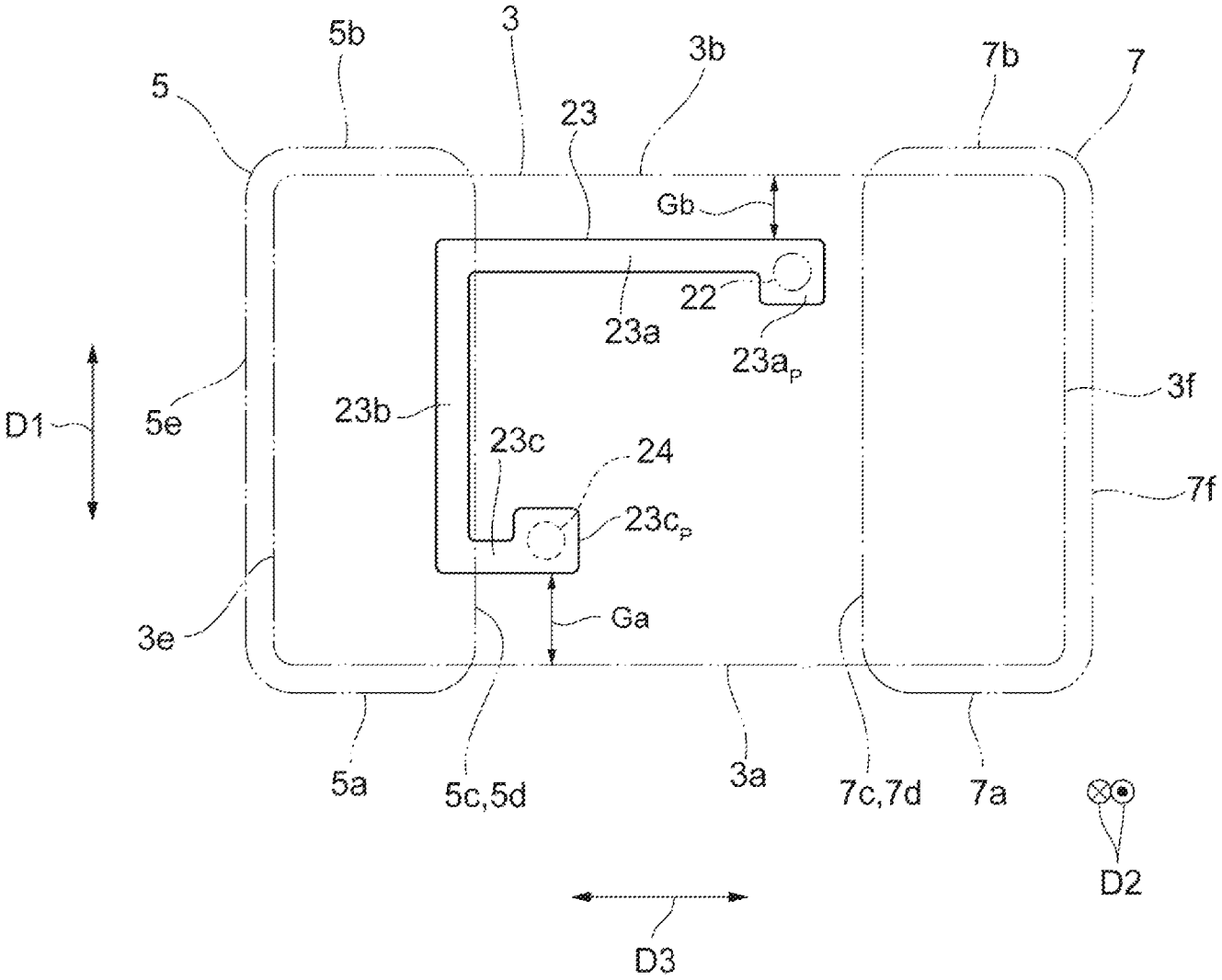
FIG. 5 is a diagram illustrating a configuration of a coil conductor and a through-hole conductor.

As illustrated in FIG. 5, the coil conductor 23 includes a plurality of conductor portions 23*a*, 23*b*, and 23*c*. The conductor portion 23*a* is positioned closer to the principal surface 3*b*. The conductor portion 23*b* is positioned closer to the end surface 3*e*. The conductor portion 23*c* is positioned closer to the principal surface 3*a*. The conductor portion 23*a* includes a pad region $23a_P$. The pad region $23a_P$ is positioned at an end of the conductor portion 23*a*. The conductor portion 23*c* includes a pad region $23c_P$. The pad region $23c_P$ is positioned at an end of the conductor p portion art 23*c*. A conductor width of each of the pad regions $23a_P$ and $23c_P$ is larger than a conductor width of the region other than the pad regions $23a_P$ and $23c_P$. When viewed from the second direction D2, the pad regions $23a_P$ and $23c_P$ do not overlap the terminal electrodes 5 and 7. The pad regions $23a_P$ and $23c_P$ are positioned to be exposed from the terminal electrodes 5 and 7 when viewed from the second direction D2.

Figure 6:
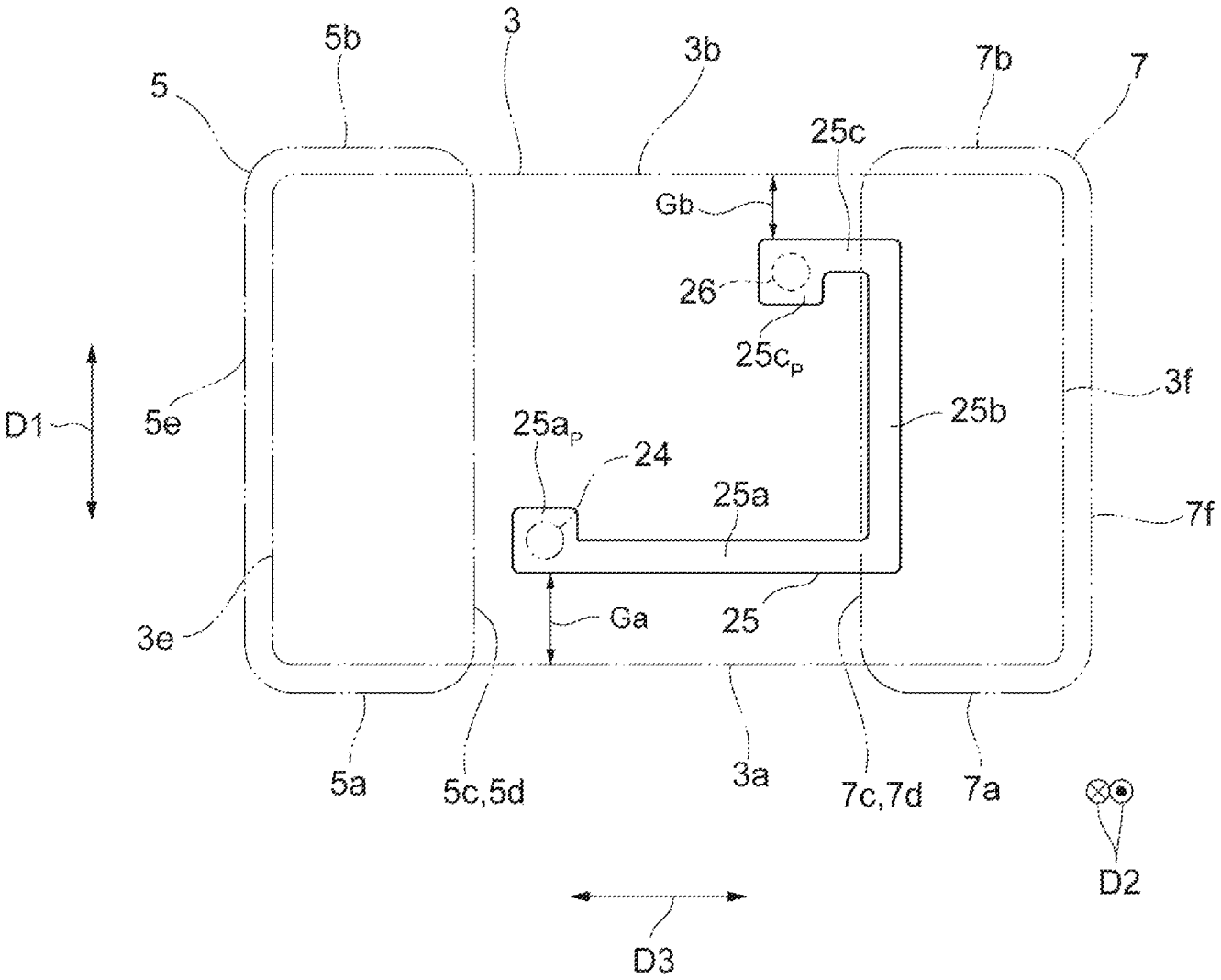
FIG. 6 is a diagram illustrating a configuration of a coil conductor and a through-hole conductor.

As illustrated in FIG. 6, the coil conductor 25 includes a plurality of conductor portions 25*a*, 25*b*, and 25*c*. The conductor portion 25*a* is positioned closer to the principal surface 3*a*. The conductor portion 25*b* is positioned closer to the end surface 3*f*. The conductor portion 25*c* is positioned closer to the principal surface 3*b*. The conductor portion 25*a* includes a pad region $25a_P$. The pad region $25a_P$ is positioned at an end of the conductor portion 25*a*. The conductor portion 25*c* includes a pad region $25c_P$. The pad region $25c_P$ is positioned at an end of the conductor portion 25*c*. A conductor width of each of the pad regions $25a_P$ and $25c_P$ is larger than a conductor width of the region other than the pad regions $25a_P$ and $25c_P$. When viewed from the second direction D2, the pad regions $25a_P$ and $25c_P$ do not overlap the terminal electrodes 5 and 7. The pad regions $25a_P$ and $25c_P$ are positioned to be exposed from the terminal electrodes 5 and 7 when viewed from the second direction D2.

Figure 7:
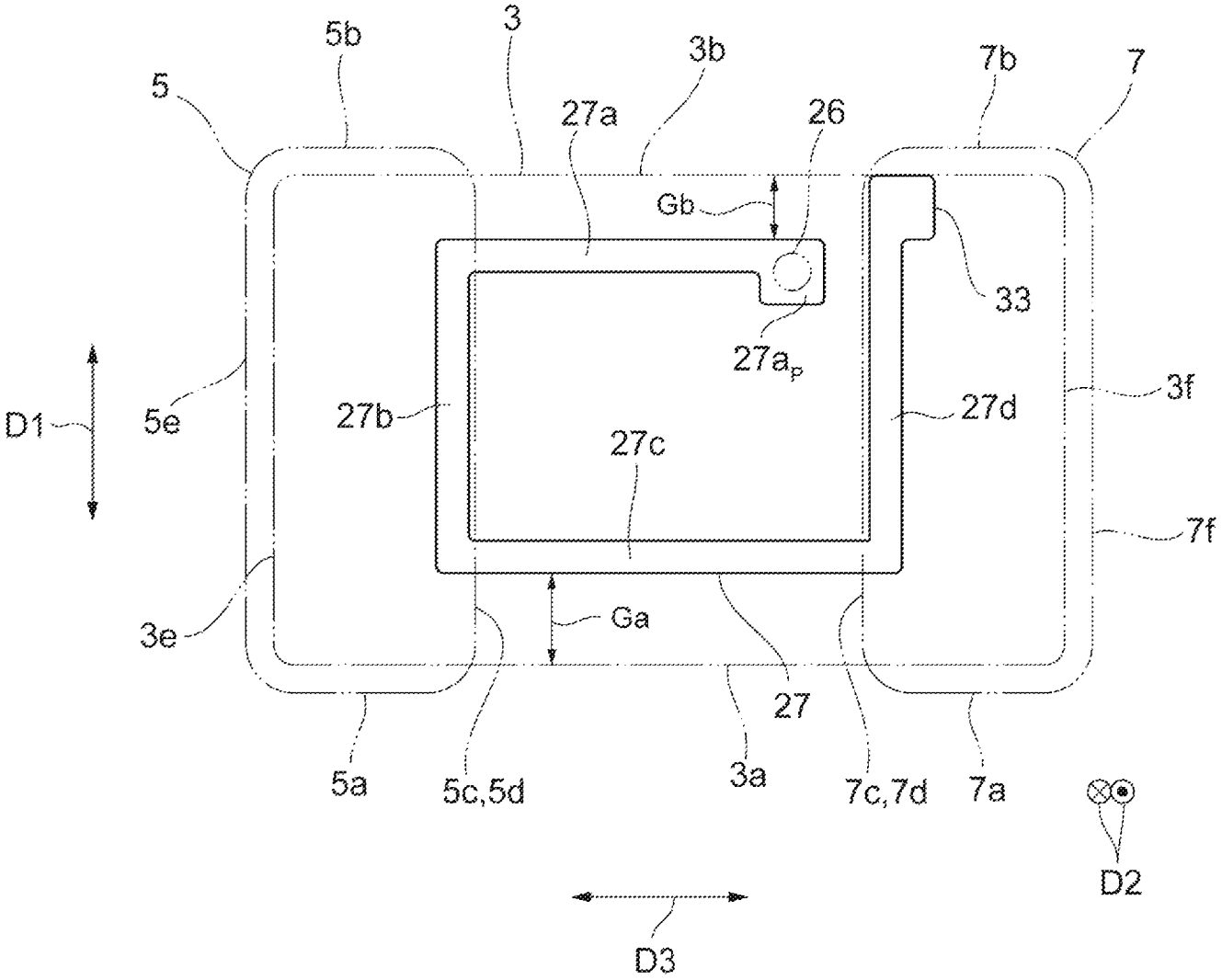
FIG. 7 is a diagram illustrating a configuration of a coil conductor and a through-hole conductor.

The coil conductor 27 includes a plurality of conductor portions 27*a*, 27*b*, 27*c*, and 27*d* as illustrated in FIG. 7. The conductor portion 27*a* is positioned closer to the principal surface 3*b*. The conductor portion 27*b* is positioned closer to the end surface 3*e*. The conductor portion 27*c* is positioned closer to the principal surface 3*a*. The conductor portion 27*d* is positioned closer to the end surface 3*f*. The conductor portion 27*a* includes a pad region $27a_P$. The pad region $27a_P$ is positioned at an end of the conductor portion 27*a*. A conductor width of the pad region $27a_P$ is larger than a conductor width of the region other than the pad region $27a_P$. When viewed from the second direction D2, the pad region $27a_P$ does not overlap the terminal electrodes 5 and 7. The pad region $27a_P$ is positioned to be exposed from the terminal electrodes 5 and 7 when viewed from the second direction D2.

The through-hole conductor 22 connects the pad region $21d_P$ and the pad region $23a_P$. The coil conductor 21 and the coil conductor 23 are connected by the through-hole conductor 22. The through-hole conductor 22 connects the coil conductors 21 and 23 among the plurality of coil conductors 21, 23, 25, and 27. The coil conductors 21 and 23 are adjacent to each other in the second direction D2. The coil conductor 21 and the coil conductor 23 are electrically connected through the through-hole conductor 22. The pad regions $21d_P$ and $23a_P$ do not overlap the terminal electrodes 5 and 7 when viewed from the second direction D2, and thus the through-hole conductor 22 also does not overlap the terminal electrodes 5 and 7 when viewed from the second direction D2.

The through-hole conductor 24 connects the pad region $23c_P$ and the pad region $25a_P$. The coil conductor 23 and the coil conductor 25 are connected by the through-hole conductor 24. The through-hole conductor 24 connects the coil conductors 23 and 25 among the plurality of coil conductors 21, 23, 25, and 27. The coil conductors 23 and 25 are adjacent to each other in the second direction D2. The coil conductor 23 and the coil conductor 25 are electrically connected through the through-hole conductor 24. The pad regions $23c_P$ and $25a_P$ do not overlap the terminal electrodes 5 and 7 when viewed from the second direction D2, and thus the through-hole conductor 24 also does not overlap the terminal electrodes 5 and 7 when viewed from the second direction D2.

The through-hole conductor 26 connects the pad region $25c_P$ and the pad region $27a_P$. The coil conductor 25 and the coil conductor 27 are connected by the through-hole conductor 26. The through-hole conductor 26 connects the coil conductors 25 and 27 among the plurality of coil conductors 21, 23, 25, and 27. The coil conductors 25 and 27 are adjacent to each other in the second direction D2. The coil conductor 25 and the coil conductor 27 are electrically connected through the through-hole conductor 26. The pad regions $25c_P$ and $27a_P$ do not overlap the terminal electrodes 5 and 7 when viewed from the second direction D2, and thus the through-hole conductor 26 also does not overlap the terminal electrodes 5 and 7 when viewed from the second direction D2.

Each of gaps Ga between the conductor portions 21*b*, 23*c*, 25*a*, and 27*c* and the principal surface 3*a* is larger than each of gaps Gb between the conductor portions 21*d*, 23*a*, 25*c*, and 27*a* and the principal surface 3*b*. The coil 20 is disposed in the element body 3 such that a gap between the coil 20 and the principal surface 3*a* is larger than a gap between the coil 20 and the principal surface 3*b*. The coil 20 is positioned closer to the principal surface 3*b* in the first direction D1. The gap Ga is also the gap between the coil 20 and the principal surface 3*a*. The gap Gb is also the gap between the coil 20 and the principal surface 3*b*. The gaps Ga and Gb are lengths in the first direction D1. In the present embodiment, the gaps Ga are equivalent to each other and the gaps Gb are equivalent to each other. In the present specification, "equivalent" does not necessarily mean only that values are matched. Even in a case where values include a manufacturing error, a measurement error, or the like, the values may be equivalent. The gaps Ga may be different from each other, and the gaps Gb may be different from each other. In this case, the minimum value of the gap Ga may be larger than the maximum value of the gap Gb.

The connection conductor 31 includes a first end connected to an end of the coil conductor 21 and a second end exposed on the principal surface 3*b*. The first end of the connection conductor 31 is connected to the conductor portion 21*a*. In the present embodiment, the connection conductor 31 is formed integrally and continuously with the coil conductor 21. The second end of the connection conductor 31 is connected to the electrode portion 5*b*. The connection conductor 31 connects a first end of the coil 20 and the terminal electrode 5 corresponding to each other. The terminal electrode 5 is electrically connected to the coil 20 through the connection conductor 31. The connection conductor 31 extends along the first direction D1. The connection conductor 31 has an approximately linear shape. The connection conductor 31 has a width, and thus the connection conductor 31 actually has an approximately rectangular plate shape. Although a width of the connection conductor 31 is larger than a width of the coil conductor 21 in the present embodiment, the width of the connection conductor 31 may be equal to or smaller than the width of the coil conductor 21.

The connection conductor 33 includes a first end connected to an end of the coil conductor 27 and a second end exposed on the principal surface 3*b*. The first end of the connection conductor 33 is connected to the conductor portion 27*d*. In the present embodiment, the connection conductor 33 is formed integrally and continuously with the coil conductor 27. The second end of the connection conductor 33 is connected to the electrode portion 7*b*. The connection conductor 33 connects a second end of the coil 20 and the terminal electrode 7 corresponding to each other. The terminal electrode 7 is electrically connected to the coil 20 through the connection conductor 33. The connection conductor 33 extends along the first direction D1. The connection conductor 33 has an approximately linear shape. The connection conductor 33 has a width, and thus the connection conductor 33 actually has an approximately rectangular plate shape. Although a width of the connection conductor 33 is larger than a width of the coil conductor 27 in the present embodiment, the width of the connection conductor 33 may be equal to or smaller than the width of the coil conductor 27. The coil 20 includes the first end connected to the connection conductor 31 and the second end connected to the connection conductor 33.

As described above, in the multilayer coil component 1, the coil 20 is disposed in the element body 3 such that the gap between the coil 20 and the principal surface 3*a* (gap Ga) is larger than the gap between the coil 20 and the principal surface 3*b* (gap Gb).

In the configuration in which the gap Ga is larger than the gap Gb, the gap Ga tends to be left and the coil 20 tends to be away from the principal surface 3*a*. Therefore, even in a case where sinterability of a region of the element body 3 that is positioned near the coil 20 is enhanced, an external force tends not to act on the region that is positioned near the coil 20. Consequently, the multilayer coil component 1 controls occurrence of cracks in the element body 3. For example, in a case where the coil conductors 21, 23, 25, and 27 (conductive paste) contain Ag, the Ag promotes sintering of the glass component that constitutes the element body 3.

In the configuration in which the gap Gb is smaller than the gap Ga, an inner diameter of the coil 20 tends not to decrease even in a case where the coil 20 is away from the principal surface 3*a*. Therefore, the multilayer coil component 1 controls a decrease in inductance.

The connection conductors 31 and 33 extend along the first direction D1. In other words, the connection conductors 31 and 33 have the approximately linear shape. In this configuration, a length of each of the connection conductors 31 and 33 is small and a change in shape tends not to occur in any place as compared with, for example, a configuration in which the connection conductors 31 and 33 have an approximately L shape. A decrease in Q value may occur in a case where the connection conductors 31 and 33 have a region where a change in shape occurs. Therefore, the multilayer coil component 1 controls an increase in direct current resistance of the connection conductors 31 and 33 and a decrease in Q value.

When viewed from the second direction D2, the through-hole conductors 22, 24, and 26 do not overlap the terminal electrodes 5 and 7. The through-hole conductors 22, 24, and 26 are connected to ends of the coil conductors 21, 23, 25, and 27. At the ends of the coil conductors 21, 23, 25, and 27, the conductor width is increased so that the ends of the coil conductors 21, 23, 25, and 27 and the through-hole conductors 22, 24, and 26 are reliably connected. In a configuration in which the through-hole conductors 22, 24, and 26 overlap the terminal electrodes 5 and 7 when viewed from the second direction D2, the ends of the coil conductors 21, 23, 25, and 27 may overlap the terminal electrodes 5 and 7 when viewed from the second direction D2. In this case, stray capacitance that is formed between the coil 20 and the terminal electrodes 5 and 7 may increase due to the large conductor width at the ends of the coil conductors 21, 23, 25, and 27. The increase in stray capacitance results in a decrease in a self-resonant frequency of the multilayer coil component 1. In contrast, in the configuration in which the through-hole conductors 22, 24, and 26 do not overlap the terminal electrodes 5 and 7 when viewed from the second direction D2, the stray capacitance that is formed between the coil 20 and the terminal electrodes 5 and 7 tends not to increase and the self-resonant frequency of the multilayer coil component 1 tends not to decrease even in a case where the conductor width at the ends of the coil conductors 21, 23, 25, and 27 is large.

Consequently, the multilayer coil component 1 reduces deterioration in characteristics.

Although the embodiment and modifications of the present invention have been described above, the present invention is not necessarily limited to the embodiment and modifications, and the embodiment can be variously changed without departing from the scope of the invention.

The shape of the coil 20 is not limited to the polygonal shape. For example, the coil 20 may have a circular shape when viewed from the second direction D2. The circular shape includes an elliptical shape or an oval shape as well as a perfectly circular shape.

The number of the coil conductors 21, 23, 25, and 27 and the number of the through-hole conductors 22, 24, and 26 are not limited to the values described above.

What is claimed is:

1. A multilayer coil component comprising:

an element body including a first principal surface arranged to constitute a mounting surface, a second principal surface opposing the first principal surface in a first direction, a pair of side surfaces opposing each other in a second direction orthogonal to the first direction, and a pair of end surfaces opposing each other in a third direction orthogonal to the first direction and the second direction;

a coil having a coil axis along the second direction, and disposed in the element body such that a gap between the coil and the first principal surface is larger than a gap between the coil and the second principal surface;

a plurality of terminal electrodes, each of the plurality of terminal electrodes overlapping the first principal surface, the second principal surface, the pair of side surfaces, and an end surface of the pair of end surfaces; and a plurality of connection conductors, a first connection conductor of the plurality of connection conductors connecting one end of the coil and a first terminal electrode of the plurality of terminal electrodes in the first direction and a second connection conductor of the plurality of connection conductors connecting a second end of the coil and a second terminal electrode of the plurality of terminal electrodes in the first direction, wherein the coil includes a plurality of coil conductors separated from each other in the second direction, and a through-hole conductor connecting the coil conductors adjacent to each other in the second direction, and the through-hole conductor does not overlap the plurality of terminal electrodes when viewed from the second direction.

2. A multilayer coil component comprising:

an element body having a first principal surface arranged to constitute a mounting surface and a second principal surface opposing the first principal surface in a first direction;

a coil (i) in the element body such that a gap between the coil and the first principal surface is larger than a gap between the coil and the second principal surface and (ii) having a coil axis along a second direction intersecting the first direction; and a plurality of terminal electrodes on the element body, each of the plurality of terminal electrodes overlaps the first principal surface and the second principal surface such that at least a part of the first principal surface and a part of the second principal surface are exposed, wherein the coil includes a plurality of coil conductors separated from each other in a direction along the coil axis, and a through-hole conductor connecting the coil conductors adjacent to each other in the direction along the coil axis, and the through-hole conductor does not overlap the plurality of terminal electrodes when viewed from the direction along the coil axis.

3. The multilayer coil component according to claim 1, wherein the each of the plurality of terminal electrodes abuts the first principal surface and the second principal surface.

* * * * *